US006314614B1

(12) United States Patent
Kuehl

(10) Patent No.: US 6,314,614 B1
(45) Date of Patent: Nov. 13, 2001

(54) PIVOT BRAKES FOR DOORS

(76) Inventor: Hans Kuehl, Kornbergweg 12, D-73207 Plochingen Deutschland (DE)

( * ) Notice: Subject to any disclaimer, the term of this patent is extended or adjusted under 35 U.S.C. 154(b) by 0 days.

(21) Appl. No.: 09/214,112

(22) PCT Filed: May 28, 1997

(86) PCT No.: PCT/EP97/02754

§ 371 Date: Aug. 12, 1999

§ 102(e) Date: Aug. 12, 1999

(87) PCT Pub. No.: WO97/49884

PCT Pub. Date: Dec. 31, 1997

(30) Foreign Application Priority Data

Jun. 26, 1996 (DE) ..... 196 25 556

(51) Int. Cl.[7] ..... E05C 17/64; E05D 7/00

(52) U.S. Cl. ..... 16/342; 16/340; 16/341; 16/354; 29/11

(58) Field of Search ..... 16/342, 340, 341, 16/354; 29/11

(56) References Cited

U.S. PATENT DOCUMENTS

| | | | | |
|---|---|---|---|---|
| 1,742,699 | * | 1/1930 | Fellows | 16/340 |
| 1,818,182 | * | 8/1931 | Woernle | 16/340 |
| 2,985,908 | | 5/1961 | Allen et al. . | |
| 3,584,333 | * | 6/1971 | Hakala | 16/341 |
| 3,965,531 | * | 6/1976 | Fox et al. | 16/341 |
| 4,332,056 | * | 6/1982 | Griffin et al. | 16/341 |
| 4,490,884 | * | 1/1985 | Vickers | 16/334 |
| 4,589,613 | * | 5/1986 | Opsahl | 16/313 |
| 4,630,333 | | 12/1986 | Vickers . | |
| 5,408,726 | * | 4/1995 | Kent | 16/326 |
| 5,765,263 | * | 6/1998 | Bolinas et al. | 16/342 |
| 5,918,348 | * | 7/1999 | Cartenter et al. | 16/342 |

FOREIGN PATENT DOCUMENTS

| | | |
|---|---|---|
| 44 06 824 A1 | 9/1975 | (DE) . |
| 90 17 065.2 | 3/1991 | (DE) . |
| 42 07 706 A1 | 9/1993 | (DE) . |
| 42 12 181 A1 | 10/1993 | (DE) . |

* cited by examiner

*Primary Examiner*—Chuck Y. Mah
(74) *Attorney, Agent, or Firm*—Crowell & Moring LLP

(57) ABSTRACT

In order to keep the braking moment in doors with a pivoting brake for the continuously progressive braking moment variation with different inclinations of the pivoting axis of the doors to the vertical within a determined range, rules given for calculating said braking moment, especially in relation to the braking moment thereof causing the door to be unintentionally closed and for an advantageous variation of said braking moment over a door pivoting angle.

6 Claims, 3 Drawing Sheets

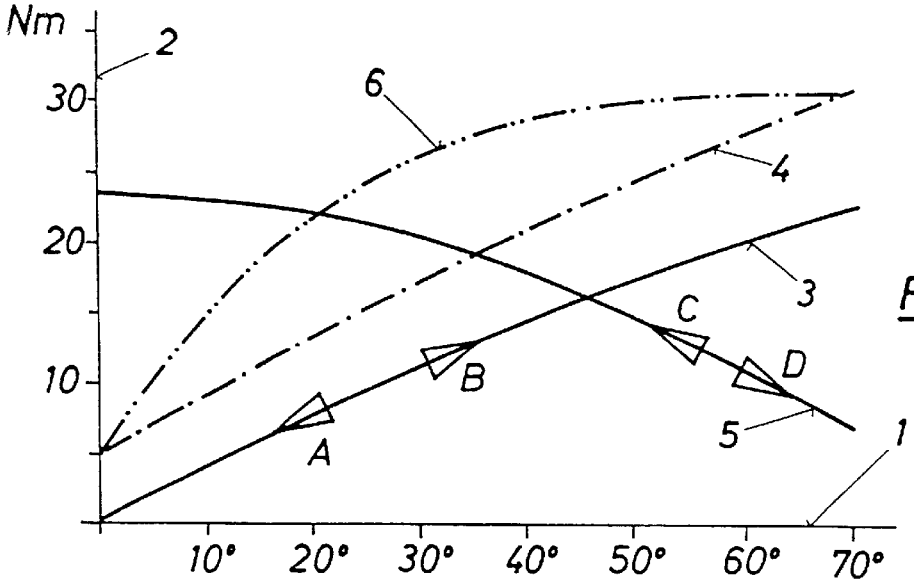
Fig. 1
Fig. 2
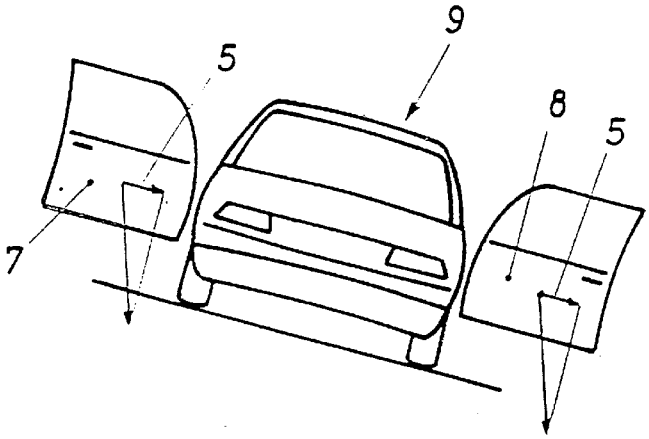
Fig. 3
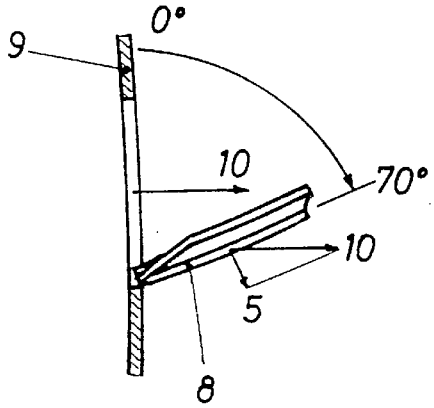

PIVOT BRAKES FOR DOORS

BACKGROUND AND SUMMARY OF THE INVENTION

This application claims the priority of German application no. 196 25 556.2 and PCT/EP97/02754, filed Jun. 26, 1996 and May 28, 1997, respectively, the disclosures of which are expressly incorporated by reference herein.

The invention relates to a swivel brake for doors with a varying inclination of their swivelling axis with respect to the vertical, such as, for example, for car doors.

DE 44 06 824 C describes a hinge having a swivel catch which, by means of circular wedge profiles on the hinge pin and in the part bearing the hinge pin, inhibits swivelling of the door by friction and/or by elastic deformation of these bearing parts. The intention thereby is for the door to have self-locking in all swivelling positions of its opening angle range.

Motor-vehicle doors, in particular, are required not to shut by themselves, unintentionally, even when the motor vehicle is parked so as to tilt longitudinally or transversely. The magnitude of the moment which triggers this shutting, and the kinetic energy which a shutting door picks up, depends on the opening angle and the door mass. In addition, the moment magnitude and kinetic energy depend substantially on the position of the door swivelling axis in space, i.e. on the inclination of a motor vehicle parked such that it tilts. Provided that the doors are hinged at the front, the "shutting moment" decreases when a vehicle is parked uphill and has a decreasing opening angle, and increases when a vehicle is parked such that it tilts transversely (at the door situated uphill).

Since, in the case of a reverse movement of the door, such as when opening the door on the uphill side of a vehicle parked such that it tilts about the longitudinal axis, the braking torque applied by a swivel catch has to be overcome, this braking torque must also not be too great.

Accordingly, the invention is directed to specifying a dimensioning rule for the braking action of the swivel brake, by way of which rule these requirements, which in part contradict one another, can best be met. The invention achieves this objective by way of the general dimensioning rule which, rather than an arbitrary development of the braking torque of the swivel brake between an assumed initial value and a final value, makes use of a braking torque developed to match the torque developed by the door. The development is determined by parameters such as weight of the door, swivel arm of the centre of gravity of the door, swivelling angle and others, when the swivelling axis is at a maximum inclination with respect to the vertical. Since these parameters can differ widely from door to door, determination of the development of the torque of the door must precede the establishing of the development of the braking torque.

When a vehicle door is opened, if the vehicle is parked such that it tilts about the transverse axis, i.e. the vehicle is parked uphill or downhill, an advantageous braking torque of the swivel brake is therefore already provided if it, in this case, exceeds the torque of the door in all swivelling positions. It is thereby achieved that at least the potential energy of the door of a vehicle parked uphill is converted in particular into heat energy which does not pose a risk for the present case.

In order to also take into account a torque which occurs due to the vehicle being inclined about a longitudinal axis, a further object of the invention is for the braking torque to exceed the torque resulting from the inclination about the transverse axis by the torque resulting from the inclination about the longitudinal axis at the maximum opening angle of the door.

An advantageous balancing of the torques is achieved when the braking torque exceeds the torque resulting from the inclination about the longitudinal axis to a greater extent in the central region of the development of the braking torque than in the initial region and in the final region.

The initial braking torque when opening the door should not exceed a certain value in order to prevent the force required for this purpose from becoming too great. The torque of the door on the uphill side of a vehicle parked such that it tilts about its longitudinal axis is at the maximum in this region. However, since the distance available for building kinetic energy as the door is shutting is small, it nevertheless appears permissible to permit the braking force of the swivel brake to fall below the torque of the door in this region.

For the final value of the braking torque of the swivel brake at the maximum opening angle of a door, a moment has proven advantageous which corresponds to the sum of the torques acting on a door in the case of a vehicle parked such that it tilts to the maximum both about the transverse axis and about the longitudinal axis.

The invention has an objective of preventing, or at least of inhibiting, automatic, unintentional shutting of a car door which can result in injuries, in particular to passengers' legs. However, car doors which fall open automatically and unintentionally can also cause damage to vehicles parked beside them.

The opening of a door of a vehicle parked downhill, i.e. tilted forwards about the transverse axis, is in all cases prevented by the braking torque which exceeds the relevant opening torque. Opening of the door on the downhill side of a vehicle tilted about the longitudinal axis is not prevented, in the case represented and described by way of example, up to an opening angle of approximately 35°. Up to this angle, the potential energy of the door is converted into kinetic energy, which is then absorbed, however, by the braking torque which substantially exceeds the opening torque.

According to the invention, the development of the braking torque can be realized on swivel brakes of differing design. Four differently designed swivel brakes on door hinges are represented and described by way of the following examples. However, development of the braking torque over the swivel path in accordance with the dimensioning rule according to the invention can also be imparted to swivel brakes which are separated from the hinge, for example in the form of brake loops.

Apart from in motor vehicles, doors having a varying inclination of their swivelling axis with respect to the vertical also occur, for example, in ships. The following description is directed primarily to car doors because the effect of the functionally correct dimensioning of a swivel brake can be shown particularly clearly on these car doors, whose operation is generally known.

Other objects, advantages and novel features of the present invention will become apparent from the following detailed description of the invention when considered in conjunction with the accompanying drawings.

BRIEF DESCRIPTION OF THE DRAWINGS

FIG. 1 shows a diagram of the moments which occur as a function of the swivelling angle;

FIG. 2 shows the front view of a passenger vehicle parked such that it tilts about the longitudinal axis;

FIG. 3 shows a schematic representation of the torques acting on a door of the passenger vehicle of FIG. 2;

DETAILED DESCRIPTION OF THE DRAWINGS

Figure 4:
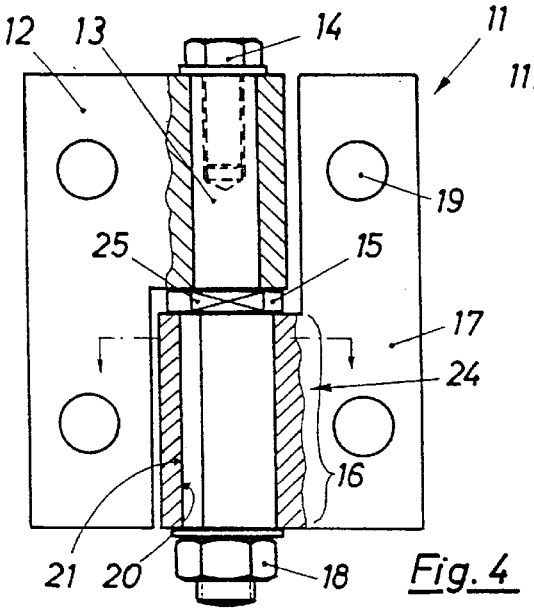
FIG. 4 shows the partially broken-away view of a hinge having a swivel brake in the form of circular wedges.

In the diagram of FIG. 1, the abscissa 1 shows the swivelling angle of a door, the ordinate 2 shows the torque, or the braking force of the swivel brake, acting on the door. The torques of doors 7 and 8 of a passenger vehicle 9 shown in FIG. 2 are illustrated. The closed position of the doors is indicated by 0°; the widest opening is assumed to be 70°. The values specified are values which have been determined for a particular vehicle. However, these values can be different in different applications, in accordance with the circumstances therein given and must be determined in each case.

The passenger vehicle 9 is shown in FIG. 2 as being tilted about its longitudinal axis. However, in the diagram of FIG. 1, both torques in the event of inclination about the longitudinal axis and about the transverse axis are plotted. For the inclination of a vehicle, one significant manufacturer proceeds from 14° with respect to the horizontal, both in the longitudinal axis and in the transverse axis thereof. The largest opening angle of car doors is generally about 70°.

Line 3 represents the development of the moment which permits in the event of a vehicle 9 is parked uphill, i.e. with an inclination about the transverse axis, the doors 7, 8, which are hinged at the front, to shut (arrow A) or to fall open (arrow B) . (This moment, which increases as the opening angle increases, is termed "torque " in the following, and includes the weight of the door, the distance of the mass centre of gravity of the door from its swivelling axis and the inclination of the plane in which the door moves and which is determined by the particular inclination of the vehicle 9. In addition, further parameters, such as wear of the hinges and, if appropriate, external influences, such as wind forces may also be included. Line 3 shows a typical development of this torque over the swivelling region of a common type of door 7, 8 on a motor vehicle 9.) However, the moments acting on a vehicle door vary within a wide range. It is therefore difficult to find a dimensioning of the braking effect of the swivel brake which takes into account, to some degree all the circumstances.

The braking torque of the swivel brake always lies above the torque 3 of the doors, ideally in accordance with the development of the dash-dotted line 4 so that doors 7, 8 are self-locking through all opening angles in the swivelling range. When the vehicle 9 is parked horizontally, no opening torque is generated. In this case, the full braking force has to be overcome when closing a door. In particular, however, when opening a door of the vehicle when parked uphill, not only the opening torque, but also the braking force have to be overcome. In order to prevent the force required for this purpose to increase too much the braking force should not lie too far above the opening torque. A moment of approximately 5 Nm has proven an expedient value for this purpose. In a given embodiment, a rise of the braking torque to approximately 30 Nm has proven advantageous.

In the case of the vehicle of FIG. 2, parked so that it tilts about the longitudinal axis, the development of the torque over the swivelling region of the doors 7, 8 is reversed, and, as can be seen from the triangle of forces drawn in in FIG. 3, decreases according to line 5 as the opening angle of the doors increases. The development of this torque 5 corresponds, in the direction of the arrow C, to a shutting movement of the uphill door 7, and in the direction of the arrow D to an opening of the downhill door 8. In the triangle of forces, arrow 10 represents the moment acting on the downhill side, which, when the door is shut, corresponds to the torque acting upon it. With the door completely opened (approximately 70°), this moment is reduced to the torque 5 of the diagram of FIG. 1. As can be seen from the triangles of forces drawn in FIG. 2, this torque 5 urges door 7 lying on the uphill side to shut, but urges door 8 lying on the downhill side to open.

At large opening angles, torque 5 is reliably covered by the development of the braking torque according to line 4. However, at opening angles of less than approximately 35°, the torque exceeds the braking torque in that region which lies between the lines 4 and 5.

Raising the braking torque above the torque even in this region would permit the force required to open a door 7, 8 at the beginning of this opening movement to rise undesirably sharply. The torque can be substantially reduced if the braking torque follows approximately in accordance with the dashed-double dotted line 6 where it is sharply raised in the central region compared with the torque development according to line 4.

Overall, when this dimensioning rule is, the results are an advantageous development of the braking force in accordance with the characteristic lines 4 or 6, whereby a door is kept in the open position. Braking of the swivelling movement of a door occurs over its entire swivelling region by a substantial part of the adjusting work being consumed in braking work, i.e. conversion into heat, and the opening force is kept within the region sought.

Such developments of braking torques can be achieved by different types of swivel brakes. In the following, four suitable embodiments for a hinge according to the invention are described, further embodiments are possible and this selection is not intended to limit the invention in form.

Figure 5:
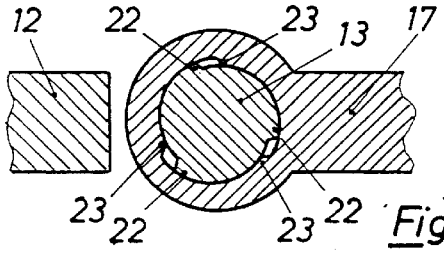
FIG. 5 shows the enlarged cross section through the subject-matter of FIG. 4 in the plane of section, indicated by arrows, of this figure.

According to FIGS. 4 and 5, a hinge 11 has a first hinge plate 12 in which a hinge pin 13 is fastened against a collar 15, braced by a screw 14. On a swivelling region 16 of the hinge pin 13, a second rotatable hinge plate 17 is secured by means of a nut 18. The hinge plates 12 or 17 can be respectively connected to the body of the vehicle 9 or its doors 7 or 8 by means of screws (not shown) which grip through the holes 19.

On the hinge pin 13 and also on the hinge plate 17, a swivelling region 16 is provided with mutually matching profiles 20, 21 in the form of circular wedges. Circular wedge profiles as contemplated by the invention are wedges 22 which protrude radially. Wedges 22 increase in the circumferential direction, over an imaginary cylindrical surface on the hinge pin 13 and are offset by the same distances in the circumferential direction. Correspondingly arranged wedges 23 protrude radially inwards over an imaginary cylindrical surface of somewhat larger diameter in the hinge plate 17. Wedges 22 and 23 each taper off steeply again onto the cylindrical surfaces. These profiles 20, 21 have a joining clearance which allows the fitting of the hinge 11 and which is cancelled out on rotation of the hinge pin 13 into a starting position. Proceeding from this starting position, the backs of the wedges 22, 23 slide onto one another with increasing surface pressure as the hinge 11 is swivelled. This results in increased braking of the swivelling movement of the hinge. Purely linear contact of the backs of the wedges 22, 23 sliding onto one another is avoided if, according to the invention, the rise of the surfaces of these backs follows a logarithmic spiral.

The parameters which determine the braking effect of a hinge of this type, and which are selected appropriately to dimension this braking effect and are to be matched to one another, are:

- the number of wedges 22, 23;
- the pitch of the wedges,
- the length of the wedges in the axial direction of the hinge 11,
- the coefficient of friction of the wedge surfaces sliding on one another,
- the joining clearance of the wedges, which determines the beginning of the braking effect,
- the modulus of elasticity of the parts entering into engagement with one another.

The effects of these parameters on the braking effect is explained in DE 44 06 824 C cited earlier and to which reference is also made to this extent.

The braking effect of swivel brake 24 can be changed by rotation of the hinge pin 13, which leads to a change in the surface pressure between the circular wedges 22, 23 in the starting position and hence an increase thereof as the hinge is swivelled. As a consequence thereof a change in the level of the braking torque is developed. For this purpose, the fastening of the hinge pin 13 in the hinge plate 12 is released by loosening the screw 14 and the hinge pin is rotated by means of a tool acting on a key surface 25.

Figure 6:
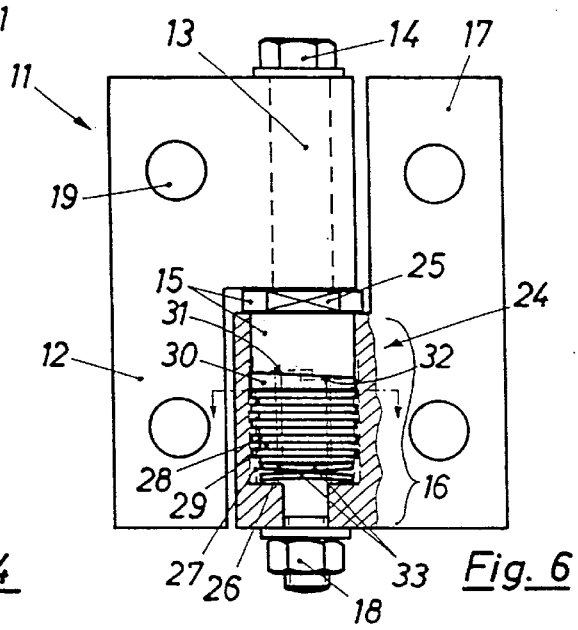
FIG. 6 shows the partially broken-away view of a hinge having a swivel brake in the form of a multi-disc brake.
Figure 7:
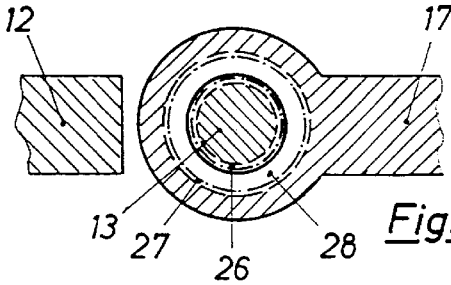
FIG. 7 shows the enlarged cross section through the subject-matter of FIG. 6 in the plane of section, indicated by arrows, of this this figure.

Another embodiment of the present invention is illustrated in FIGS. 6 and 7. The swivel brake 24 is designed as a multi-disc brake. On the hinge pin 13 and also in the hinge plate 17, one section of the swivelling region 16 is provided with a plurality of teeth 26, 27, in which are guided a plurality of annular brake plates 28, 29, which are provided with corresponding teeth on the inner or outer edge, respectively. Also guided in the teeth 26 of the hinge plate 17 is a climbing disc 30 whose climbing surface 31 interacts, on its upper side, with a corresponding climbing surface 32 on the lower end surface of the collar 15. The brake plates 28, 29 are accordingly connected in a rotationally fixed manner alternately with the hinge pin 13 and with the hinge plate 17 and rotate with respect to one another when the hinge 11 is swivelled. Disc springs 33 are arranged on that side of the plate assembly which is,opposite the climbing disc 30.

When the hinge is swivelled, the climbing surfaces 31, 32 slide onto one another and increasingly press the brake plates 28, 29 onto one another, counter to the action of the disc springs 33. The result is and increase in braking effect increases with increasing swivelling angle of the hinge. This braking effect can be changed, just as described above for the embodiment of FIGS. 4 and 5, by rotation of the hinge pin 13 in the hinge plate 17. The starting position of the climbing surfaces 31, 32, as a result of the latter, and the braking effect are thereby changed.

Figure 8:
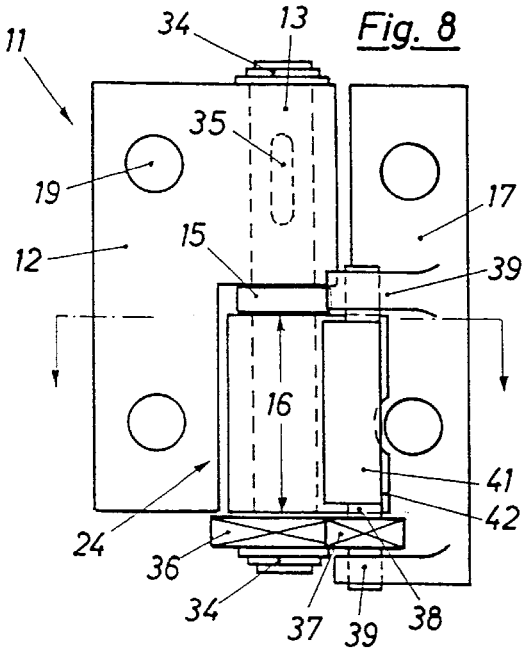
FIG. 8 shows the view of a hinge having a swivel brake in the form of a slotted, contractable bearing eye.
Figure 9:
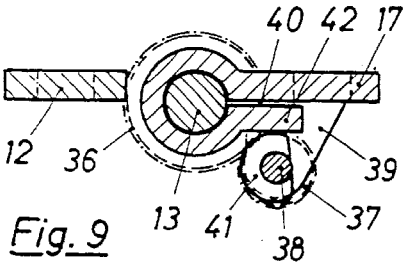
FIG. 9 shows the cross section through the subject-matter of FIG. 8 in the plane of section, indicated by arrows, of this figure.

In the embodiment of FIGS. 8 and 9, the hinge pin 13 is supported in the hinge plates 12 and 17 by means of Seeger circlip rings 34 and is secured in the hinge plate 12 against rotation by means of a groove and tongue 35. The swivel brake 24 is formed by the bearing eye of the hinge plate 17, which is of open design and has a gap 40. On the hinge pin 13 there is fastened, in a rotationally fixed manner, a toothed ring 36 which is engaged with a toothed wheel 37. Toothed wheel 37 is seated on a shaft 38 which can be rotated in bearings 39 on the hinge plate 17. A cam 41 is arranged on the shaft 38, which cam presses onto the free end 42 of the bearing eye of the hinge plate 17.

When the hinge 11 is swivelled, the toothed ring 36, which is connected to the hinge pin 13, and the toothed wheel 37 cause the shaft 38 and the cam 41 to rotate. This causes the cam 41 to increasingly press onto the free end 42 of the bearing eye of the hinge plate 17 contracting this bearing eye. As a result, the friction in this bearing, and hence the braking torque, is progressively increased. The development of the braking torque can be selected by means of the shape of the cam 41.

Figure 10:
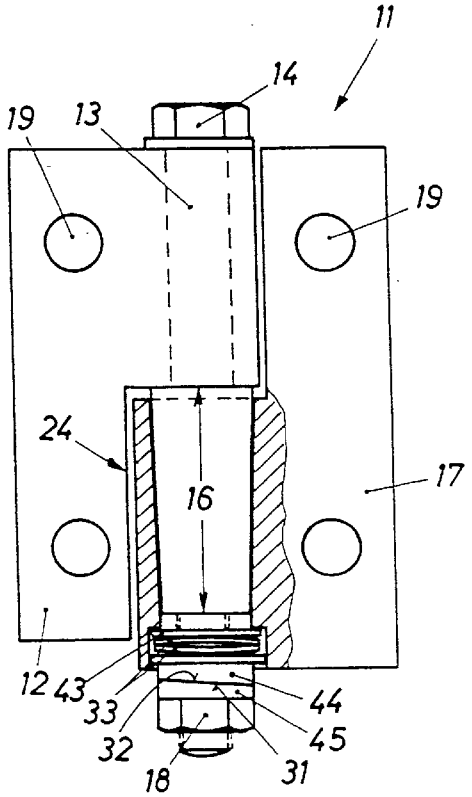
FIG. 10 shows the partially broken away view of a hinge having a swivel brake in the form of a conical brake.

Finally, FIG. 10 shows an embodiment of the swivel brake 24 as a conical brake. Both the bearing eye of the hinge plate 17 and also the hinge pin 13 are of conical design in the swivelling region 16 and, when the hinge is swivelled, slide on these conical surfaces. The bearing eye of the hinge plate 17 is supported on a disc 43 against which bears disc springs 33 which lie on the other side on a climbing disc 44. This climbing disc 44 is guided in a rotationally fixed manner. However, it can be displaced axially in the bearing eye of the hinge plate 17, for example by this bearing eye being of polygonal design in this region. The climbing surface 31 of a climbing disc 45 which is non-rotatably fastened by means of a nut 18 on that end region of the hinge pin 13. Hinge pin 13 is provided with a thread bearing against the climbing surface 32 of the climbing disc 44.

When the hinge 11 is swivelled, the climbing surfaces 31, 32 slide onto one another and press the conical bearing eye of the hinge plate 17 with increasing strength under increasing tension of the disc springs 33, onto the conical bearing region 16 of the hinge pin 13. The braking effect is thereby increased. The braking torque can be determined here by pretensioning of the disc springs 33 by the nut 18.

In the embodiments of FIGS. 6, 7 and 10, the development of the braking torque of the swivel brake 24 can be determined by means of the selection of the disc springs 33 and by means of the development of the rise of the climbing surfaces 31, 32. The braking torque can be changed by rotation of the hinge pin 13. In this manner, for example a rise of these climbing surfaces which decreases as the swivelling angle increases can smooth down the rise in braking torque according to the line 6 of FIG. 1.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method of braking a door of a vehicle which in use exhibits a varying inclination of a hinge axis about vertical during tilting of the vehicle, comprising:

determining torques of the door over varying opening angles of the door when the hinge axis is at a maximum inclination about the vertical;

setting braking torques of a swivel brake at least as great as said determined torques over the opening angles to match the determined torques of the door over the opening angles of the door; and providing the swivel brake for the door of a vehicle.

2. Method of braking door according to claim 1, wherein the maximum inclination is about a transverse axis of the vehicles, and the braking torques set exceed the determined torques of the door over the opening angles of the door.

3. Method of making a swivel brake according to claim 2, wherein the braking torques exceed the determined torques of the door over the opening angles of the door by at most 5 Nm.

4. Method of making a swivel brake according to claim 3, wherein the braking torques set exceed the determined torques of the door to a greater extent in a central region of the opening angles than in a lower region and an upper region of the opening angles when the maximum inclination is about a transverse axis of the vehicle.

5. Method of making a swivel brake according to claim 1, wherein the maximum inclination is about a transverse axis of the vehicle and about a longitudinal axis of the vehicle, and the braking torques are set, for a maximum opening angle of the door, to at least a sum of the determined torque from inclination about a longitudinal axis and the determined torque from inclination about a transverse axis.

6. Method of making a swivel brake according to claim 1, wherein the swivel brake is a mutually matching combination of circular wedge profiles on a hinge pin and in a hinge plate, said wedge profiles including rises of surfaces which follow a logarithmic spiral.

* * * * *